US012520930B2

(12) United States Patent
Patoglu

(10) Patent No.: US 12,520,930 B2
(45) Date of Patent: Jan. 13, 2026

(54) SUSPENDED-LOAD BACKPACK COMPRISING ADJUSTABLE IMPEDANCE SUSPENSION SYSTEM

(71) Applicant: SABANCI UNIVERSITESI, Istanbul (TR)

(72) Inventor: Volkan Patoglu, Istanbul (TR)

(73) Assignee: SABANCI UNIVERSITESI, Istanbul (TR)

( * ) Notice: Subject to any disclaimer, the term of this patent is extended or adjusted under 35 U.S.C. 154(b) by 179 days.

(21) Appl. No.: 18/579,517

(22) PCT Filed: Feb. 28, 2023

(86) PCT No.: PCT/TR2023/050195

§ 371 (c)(1),
(2) Date: Jan. 16, 2024

(87) PCT Pub. No.: WO2023/167652

PCT Pub. Date: Sep. 7, 2023

(65) Prior Publication Data

US 2024/0315432 A1 Sep. 26, 2024

(30) Foreign Application Priority Data

Mar. 1, 2022 (TR) ..... TR2022/002998

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01)

(58) Field of Classification Search
CPC ..... A45C 13/001; A45C 13/007; A45F 2003/045; A45F 2003/146; A45F 3/04;
(Continued)

(56) References Cited

U.S. PATENT DOCUMENTS 6,619,523 B1 9/2003 Duckworth
7,851,932 B2 * 12/2010 Rome ..... F03G 5/065 290/1 R
10,018,238 B2 7/2018 Patoglu

FOREIGN PATENT DOCUMENTS

CN 211794864 U * 10/2020
CN 112998387 A * 6/2021 ..... A45F 3/08
(Continued)

OTHER PUBLICATIONS

CN-211794864-U Tanslation, Su, Ye-wang, Oct. 30, 2020 (Year: 2020).*

(Continued)

*Primary Examiner* — Nathan J Newhouse
*Assistant Examiner* — Matthew T Theis
(74) *Attorney, Agent, or Firm* — Bayramoglu Law Offices LLC

(57) ABSTRACT

A suspended-load backpack comprising a loading chamber suitable for placing therein the loads to be carried; at least one strap; an adjustable impedance suspension system having a first connection portion where it is connected with the strap and a second connection portion where it is connected with the loading chamber and enabling that the movements of the loading chamber perpendicular to the ground caused by the movement of the user, when in use, are filtered; an adjustable stiffness module located on the suspension system, one end of which is connected with the first connection portion and the other end of which is connected with the second connection portion.

19 Claims, 10 Drawing Sheets

(58) Field of Classification Search
CPC .... A45F 3/047; A45F 3/08; A45F 3/10; A45F 3/14
USPC ..... 224/631
See application file for complete search history.

(56) References Cited

FOREIGN PATENT DOCUMENTS

| | | | | | |
|---|---|---|---|---|---|
| CN | 113475840 | A | * | 10/2021 | ..... A45F 3/08 |
| CN | 113679162 | A | * | 11/2021 | ..... H02J 7/32 |
| CN | 215271073 | U | * | 12/2021 | |
| EP | 2094126 | A2 | | 9/2009 | |
| EP | 2094126 | B1 | * | 4/2015 | ..... F03G 7/08 |

OTHER PUBLICATIONS

CN-112998387-A Translation, Zhu, Yan-he, Jun. 22, 2021 (Year: 2021).*
CN-113475840-A Translation, He, Jian, Oct. 8, 2021 (Year: 2021).*
CN-113679162-A Translation, Li, Bo, Nov. 23, 2021 (Year: 2021).*
CN-215271073-U Translation, Xie, An, Dec. 24, 2021 (Year: 2021).*

* cited by examiner

SUSPENDED-LOAD BACKPACK COMPRISING ADJUSTABLE IMPEDANCE SUSPENSION SYSTEM

CROSS REFERENCE TO RELATED APPLICATIONS

This application is a national stage entry of International Application No. PCT/TR2023/050195, filed on Feb. 28, 2023, which is based upon and claims foreign priority to Turkey Patent Application No. 2022/002998, filed on Mar. 1, 2022, the entire contents of which are incorporated herein by reference.

TECHNICAL FIELD

The present invention relates to a suspended-load backpack comprising an adjustable impedance suspension system.

BACKGROUND

In daily life, it is an inevitable part of routine activities to carry loads. The additional weight and inertial forces caused by the loads carried result in increased metabolic costs during movement. Moreover, continuous exposure to repetitive loads on the musculoskeletal system may cause long term injuries.

As a way to increase the user's energy efficiency while walking, suspended-load backpacks have been proposed. The suspended-load backpacks not only reduce maximum reaction forces during load carrying, but also change the timing of the loads in the walking cycle by generating a movement comprising a phase difference between the load carried and the human body. Typical applications of the suspended-load backpacks are based on a very flexible and low damping suspension. However, due to the fact that low stiffness suspensions are subject to excessive displacements under high loads, the effectiveness of such suspensions is limited to a relatively narrow range of payload and walking speed. Thus, it is difficult to effectively implement suspended-load backpacks.

A suspended-load backpack having a suspension system is described in the patent document EP2094126 (B1), which is in the state of the art.

A variable stiffness suspension system is described in the patent document U.S. Pat. No. 10,018,238 (B2), which is in the state of the art.

EP 2,094,126 A2 discloses a suspended-load backpack designed to permit the load to move relative to the wearer during walking and running so that the large movements between the load and the wearer of the backpack reduce the fluctuations of vertical motion of the load with respect to ground. Because the hip (and thus the pack body) goes up a down a good deal during walking, a large relative movement between the wearer and the load reduces the absolute excursion of the load.

The object of the present invention is to provide a suspended-load backpack having a suspension system, wherein when the suspended-load backpack is worn by the user, the movement of the loading chamber relative to the ground which is caused by the movement of the user is filtered.

SUMMARY

The suspended-load backpack of the present invention comprises a loading chamber suitable for placing therein the loads to be carried; at least one strap; an adjustable impedance suspension system having a first connection portion where it is connected with the strap and a second connection portion where it is connected with the loading chamber, and enabling that the movements of the loading chamber caused by the movement of the user, when in use, are filtered; an adjustable stiffness module located on the suspension system, an end of which is connected with the first connection portion and the other end of which is connected with the second connection portion. The strap may be in the form of a shoulder strap suitable to be worn on the shoulder of the wearer, or a waist strap suitable to be worn on the waist of the wearer. The suspension system also comprises an inerter which is connected in parallel with the adjustable stiffness module and which increases the effective inertia. After the suspended-load backpack is worn by the user, the movements of the loading chamber perpendicular or parallel to the ground during the walking or running of the user are filtered and transmitted to the user's shoulder by means of the suspension system. The suspension system filters the movements of the loading chamber by changing the natural frequency of the system. While the inerter decreases the natural frequency of the system by increasing its total inertia, the adjustable stiffness module adjusts the natural frequency by changing the spring constant of the system.

Inerter was first suggested in 2002 by M. C. Smith. Inerter is a mechanical element having two terminals corresponding to a capacitor in an electrical circuit. Unlike to the inertia/mass, one terminal of which is always connected to the ground (grounded), both terminals of the inerter are individually movable. The forces applied to the two terminals are directly proportional to the relative acceleration between the two terminals. Said proportionality has the same unit with the mass. A number of different types of inerters have been produced and used. A number of inerters with many different structures are used in applications, such as mechanical inerters, electromechanical inerters, liquid or hydraulic inerters. Mechanical inerters can be examined in two common types: ball-screw inerters and rack-and-pinion inerters. The inertia required in both types of the mechanical inerter mechanisms is provided by a flywheel. Any inerter structure can be used in the suspension system proposed in the invention.

In an embodiment of the invention, the adjustable stiffness module comprises at least one bendable beam suitable to be connected to the loading chamber; a movement mechanism suitable for applying force to the beam from at least one end of the beam; a spring having one end connected with the first connection portion and the other end connected with the second connection portion. The spring is a positive stiffness spring. The value of the spring constant of the beam can be adjusted by applying force to the beam through the movement mechanism. In this way, an adjustable stiffness module is obtained. The movement mechanism is movable either manually or automatically.

In an embodiment of the invention, said adjustable stiffness module comprises a connection base, which is connected to the beam at one end and suitable for connecting the loading chamber thereon. With the connection base, the loading chamber can be connected to and disconnected from the suspension system. Furthermore, with the connection base, the connection of the beam with the loading chamber is facilitated.

In an embodiment of the invention, the suspension system comprises a first connection element, which is located on the connection base and allows the loading chamber to be mounted on the connection base in a removable manner. In this way, it is facilitated to place the loading chamber on the connection base and to detach it therefrom.

In an embodiment of the invention, the suspension-load backpack comprises a second connection element that facilitates the removable mounting of the loading chamber to the connection base by mating the loading chamber with the first connection element. Thus, when the loading chamber is placed on the connection base, the loading chamber is prevented from being displaced. Furthermore, if the first connection element and the second connection element are mated by the user, it facilitates the mounting of the loading chamber to the connection base.

In an embodiment of the invention, the suspension system comprises a connection base connected to the central point of the said beam. In this way, it is facilitated to guide the loading chamber to move perpendicularly to the ground.

In an embodiment of the invention, said adjustable stiffness module comprises a connection means allowing the beam and the connection base to be manually connected and disconnected. In this way, while the beam that allows the adjustment of the stiffness of the adjustable stiffness module is connected with the suspension system, it is ensured that the working area can be separated.

In an embodiment of the invention, the suspension system comprises a spring compression mechanism that is associated with the spring and suitable for applying force to the spring. In this way, the force that the spring will apply against the weight of the loading chamber can be increased.

In an embodiment of the invention, said suspension system comprises an auxiliary damping element. In this way, the damping efficiency of the suspension system is increased.

In an embodiment of the invention, the suspended-load backpack comprises a generator. In this way, it is possible to generate energy from the movements of the loading chamber or the elements in the suspension system. In this embodiment, the movements that occur perpendicular to the ground during walking are filtered by the suspension and the displacement formed on a moving element in the suspension system is used to drive the generator and generate electrical energy by means of a reducer. In this embodiment, the generator adds damping to the system.

In an embodiment of the invention, the inerter is a ball-screw inerter including a first flywheel, a ball, and a screw. The inertia required in the ball-screw inerter is obtained by the rotation of a rotating element. In the ball-screw inerters, when the gears rotate in the opposite direction, the gap between the gears is less than the other inerters, and thus the efficiency loss is reduced.

In an embodiment of the invention, the inerter is the one comprising a flywheel pivoted using flexible mechanisms. This inerter which is based on a flexible mechanism can add ideal interance to the system by minimizing undesirable effects such as backlash, friction and damping.

In an embodiment of the invention, the inerter is the one comprising a linear harmonic reducer embodied using pulleys and ropes. The use of pulleys and ropes reduces undesirable effects such as friction and damping, while the linear harmonic reducer allows high levels of interance with low mass.

BRIEF DESCRIPTION OF THE DRAWINGS

The suspended-load backpack of the present invention is illustrated in the accompanying drawings for better understanding thereof, which drawings are just incorporated to better illustrate the present invention and are not intended to limit the invention, in which.

Figure 1:
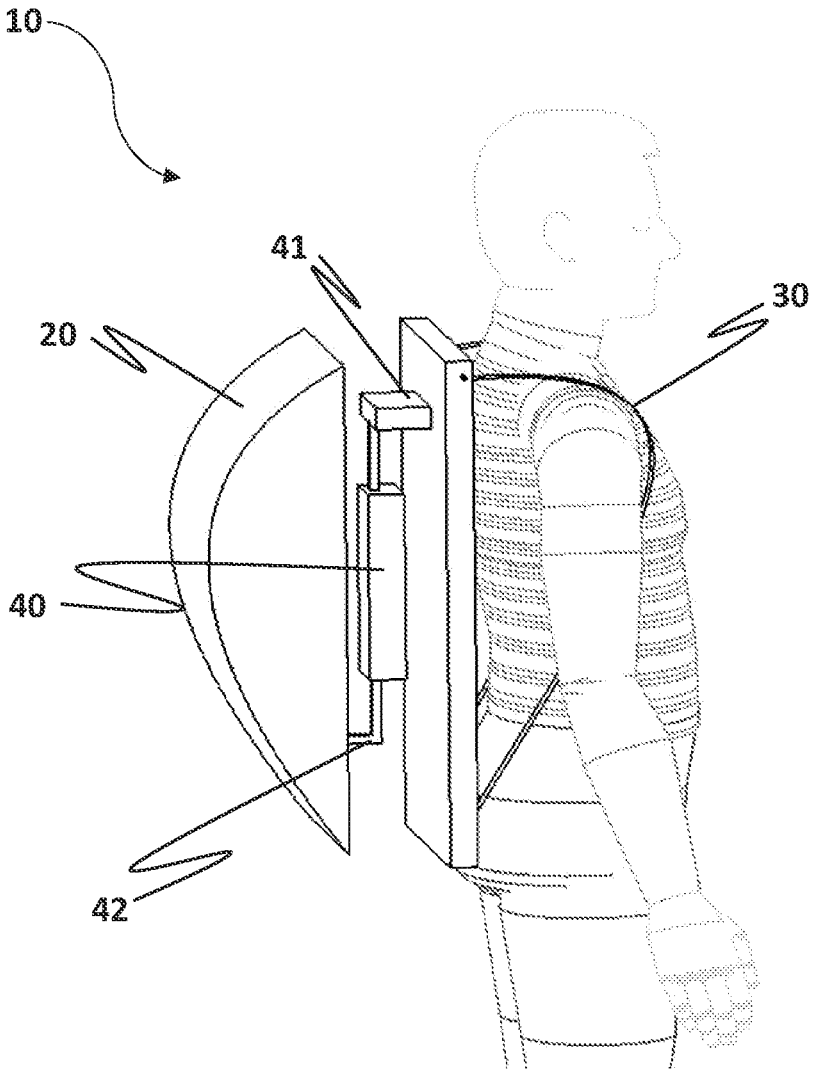
FIG. 1 is a perspective view of a suspended-load backpack of the present invention, as used on a human body.

The invention will herein be explained in detail with reference to the accompanying drawings and the list of part numbers used in the figures is as follows.

10. Suspended-load backpack
20. Loading chamber
30. Strap
40. Suspension system
  41. First connection portion
  42. Second connection portion
50. Adjustable stiffness module
  51. Beam
  52. Movement mechanism
  53. Spring
  54. Connection base
    541. First connection element
  55. Connection means
  56. Spring compression mechanism
60. Inerter
70. Auxiliary damping element
80. Generator
101. First flywheel
102. Nut
103. screw gear
201. Rack
202. Gear element
203. Second flywheel
204. First pinion
205. Second pinion
301. Inlet port

302. Helical tube
303. Piston
304. Rod
400. Pivoted flywheel inerter
401. Main mass
402. Additional mass
403. Pivot point
500. Flexible pivoted flywheel inerter
501. Third flywheel
502. Leg
503. Flexible rotating element
600. Linear harmonic reducer mechanism
601. Pulley
602. Rope
L1. First distance
L2. Second distance

DETAILED DESCRIPTION OF THE EMBODIMENTS

Figure 2:
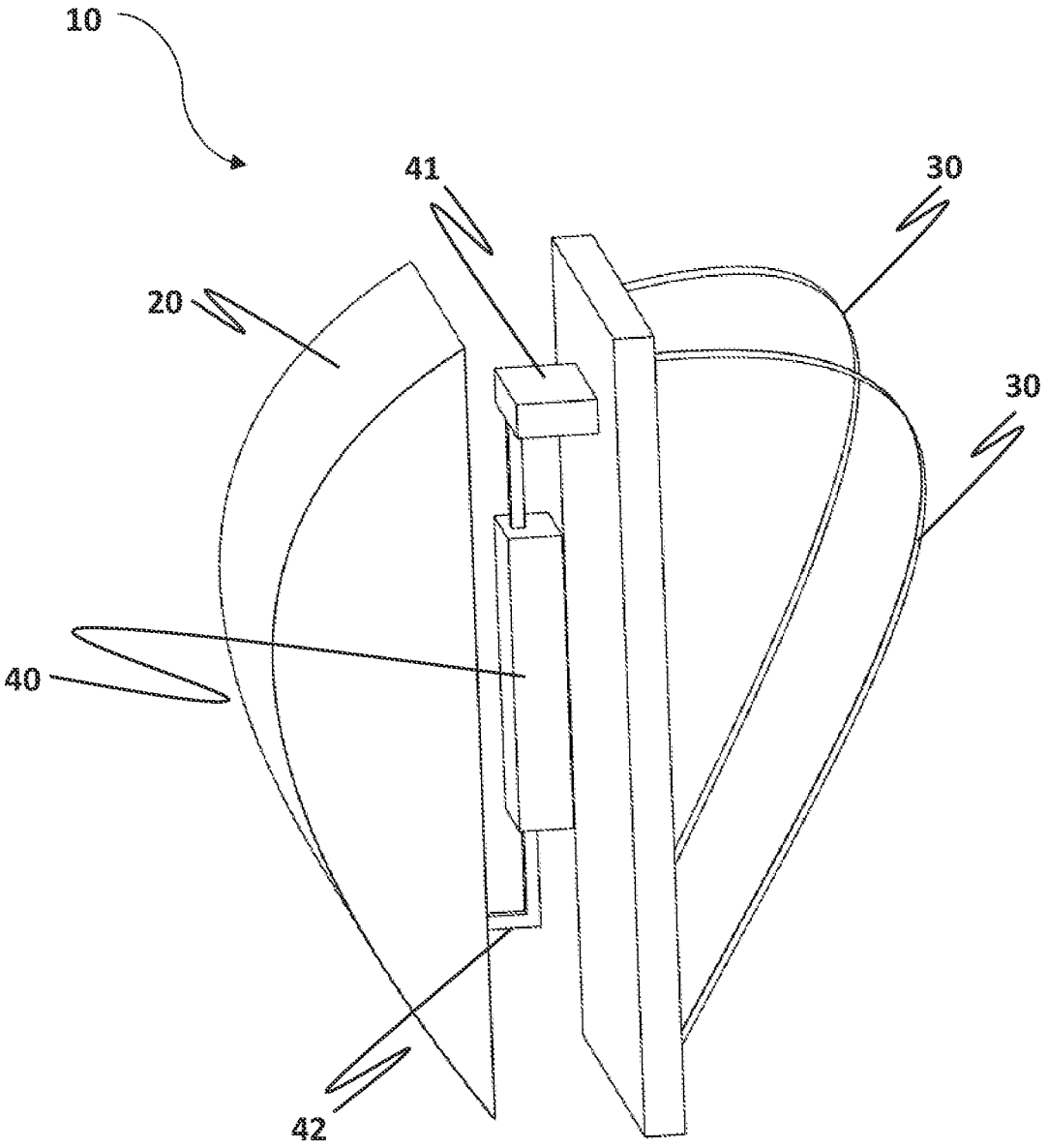
FIG. 2 is a perspective view of the suspended-load backpack of the present invention.
Figure 3:
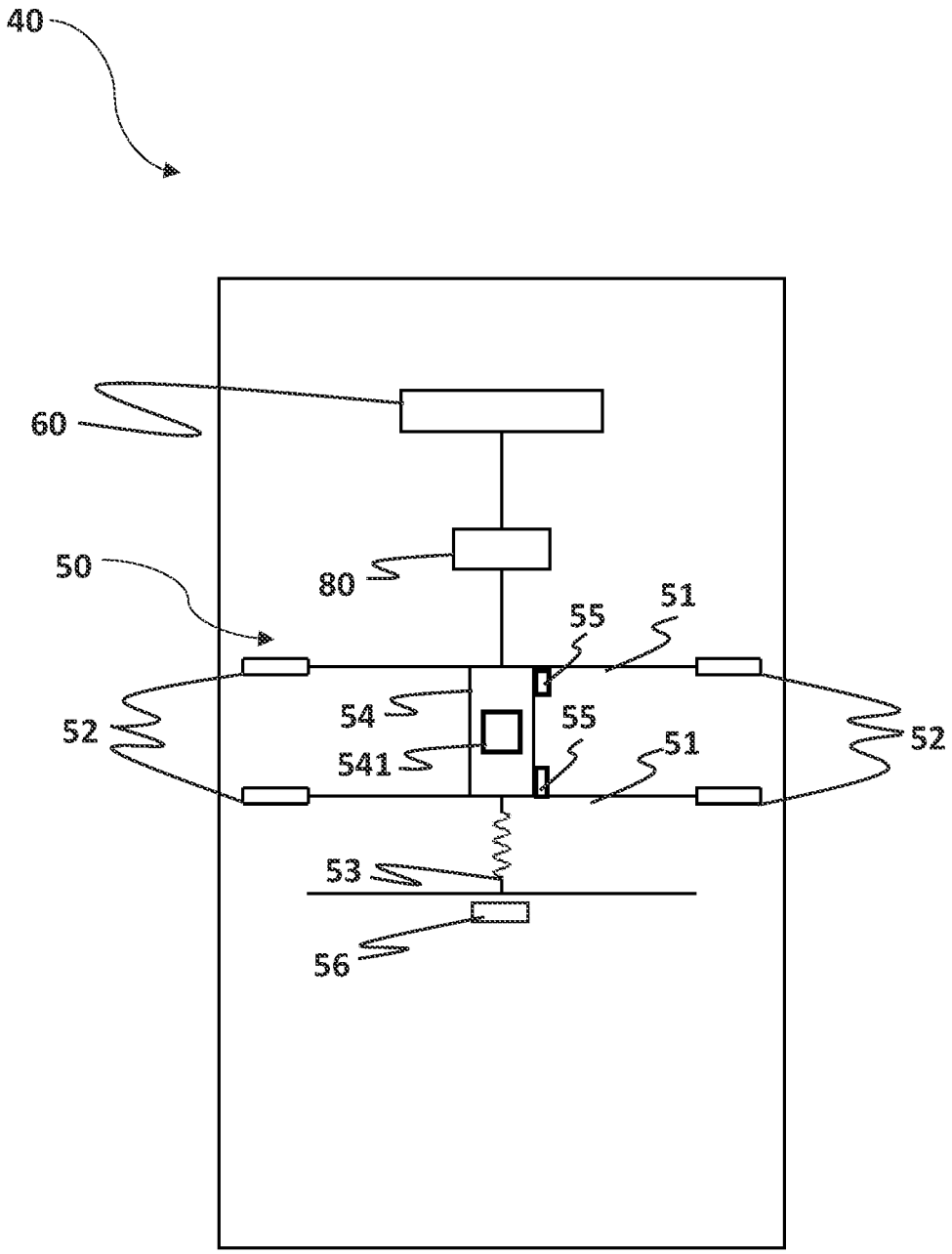
FIG. 3 is a schematic view of the suspension system of the present invention.
Figure 4:
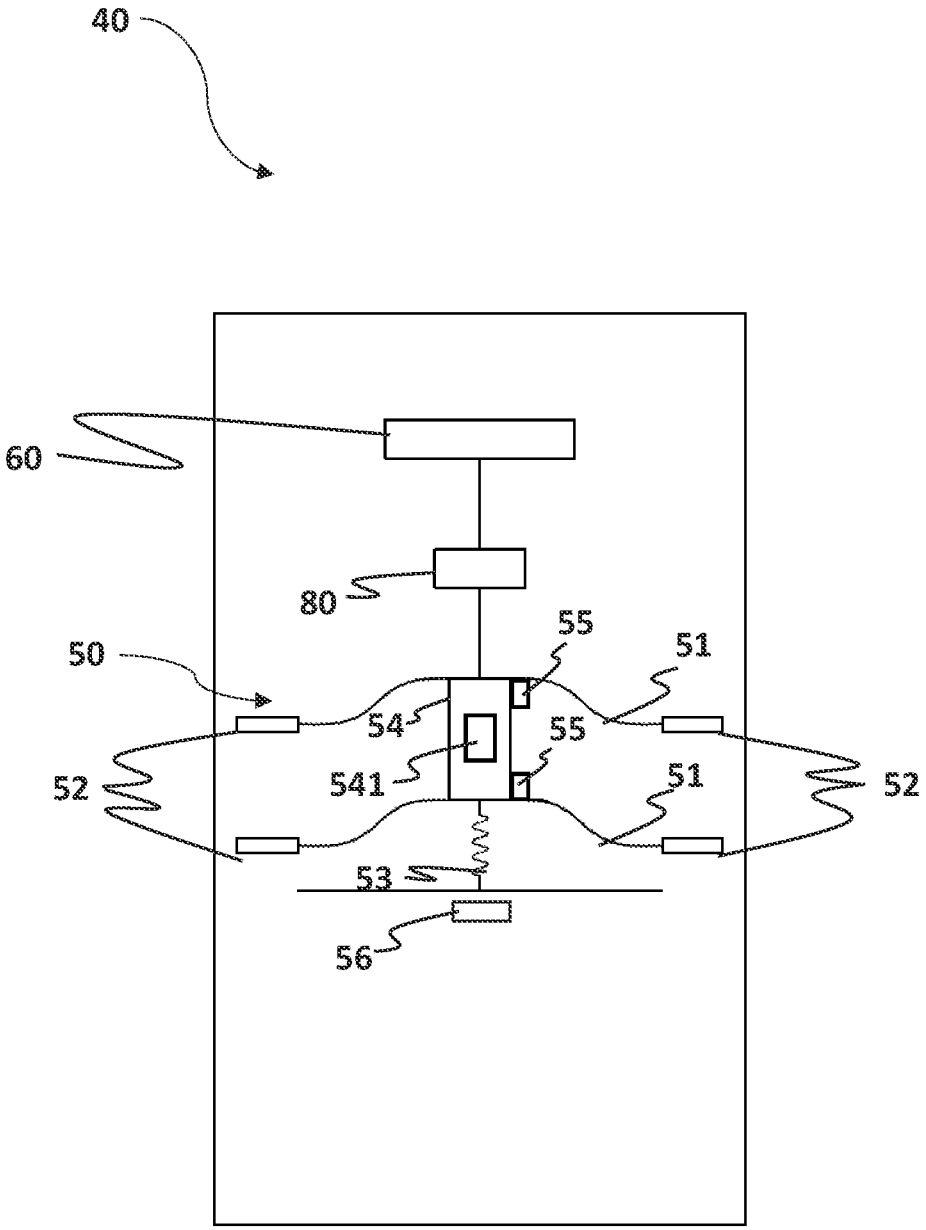
FIG. 4 is a schematic view of the suspension system of the present invention wherein the beam is bent.
Figure 5:
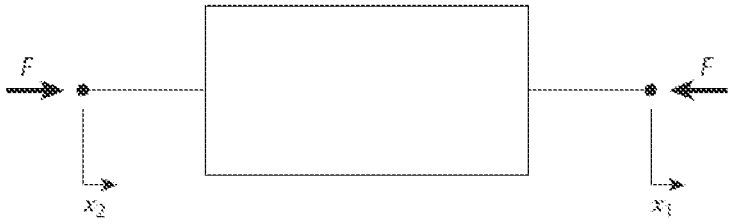
FIG. 5 is a schematic view of an ideal inerter of the present invention.

The suspended-load backpack (10) of the present invention comprises a loading chamber (20) suitable for placing therein the loads to be carried; at least one strap (30); an adjustable impedance suspension system (40) having a first connection portion (41) where it is connected with the strap (30) and a second connection portion (42) where it is connected with the loading chamber (20), and enabling that the movements of the loading chamber (20) caused by the movement of the user, when in use, are filtered; an adjustable stiffness module (50) located on the suspension system (40), an end of which is connected with the first connection portion (41) and the other end of which is connected with the second connection portion (42). The suspension system (40) allows damping and/or filtering of the movements of the loading chamber (20) perpendicular to the ground, particularly during the walking of the user. Thus, it is possible to effectively reduce the metabolic cost of carrying loads at various payloads and walking speeds. As can be seen in FIG. 1, the strap (30) is preferably used as two pieces and is hung on both shoulders of the user. As can be seen in FIG. 2, the suspended-load backpack (10) transfers the load to the strap (30) through the first connection portion (41). As can be seen in FIGS. 1 and 2, the strap (30) and the first connection portion (41) can be connected to each other via a frame. As can be seen in FIGS. 3 and 4, the suspension system (40) comprises an inerter (60) which is connected in parallel to the adjustable stiffness module (50) and which increases the effective inertia. The inerter (60) is located in the suspension system (40), between the loading chamber (20) and the strap (30). By way of the inerter (60), the total effective inertia of the system is significantly increased, without seriously increasing the weight of the system. The mathematical equation of the ideal inerter (60) shown in FIG. 5 is given in Equation 1:

$$F(t) = b(\dot{x}_2(t) - \dot{x}_1(t)) \quad \text{(Equation 1)}$$

Here b is greater than 0 and corresponds to inertance. As can be seen from FIG. 5, the forces applied to the terminals are equal and opposite. The article, entitled "The inerter: A retrospective" by Malcolm C. Smith, reports the features required for a unit to be considered as an inerter (60). The first one of them is that the unit's own weight should be as low as possible, regardless of the required inertance value. The second one is that there is no need to add any physical connection points to the mechanical ground. The third one is that said unit must have determinable finite linear motion and the dimensions of the unit must be subject to reasonable restrictions. And, the fourth one is that said unit operates adequately in any spatial orientation and movement.

The inerter (60) is incorporated into the suspension system (40) in order to lower the natural frequency ($\omega_n$) of the suspended-load backpack (10). The equation of the natural frequency ($\omega_n$) of the suspended-load backpack (10) is given in Equation 2:

$$\omega_n = \sqrt{\frac{k}{m+M}} \quad \text{(Equation 2)}$$

In Equation 2, k is the spring constant; m is the inertia of the suspended-load backpack (10) before the inerter (60) is incorporated therein; M corresponds to the inertia added to the system by the inerter (60). The unit of the inertia added to the system is kilogram. The weight of the inerter (60) to be incorporated into the suspension system (40) should be chosen as low as possible and the inertia (M) that will affect the system should be chosen as large as possible. In this way, since an increase in the total weight of the suspended-load backpack (10) will be small, the total inertia of the suspended-load backpack (10) can be increased without increasing the weight acting on the user's body.

Figure 17:
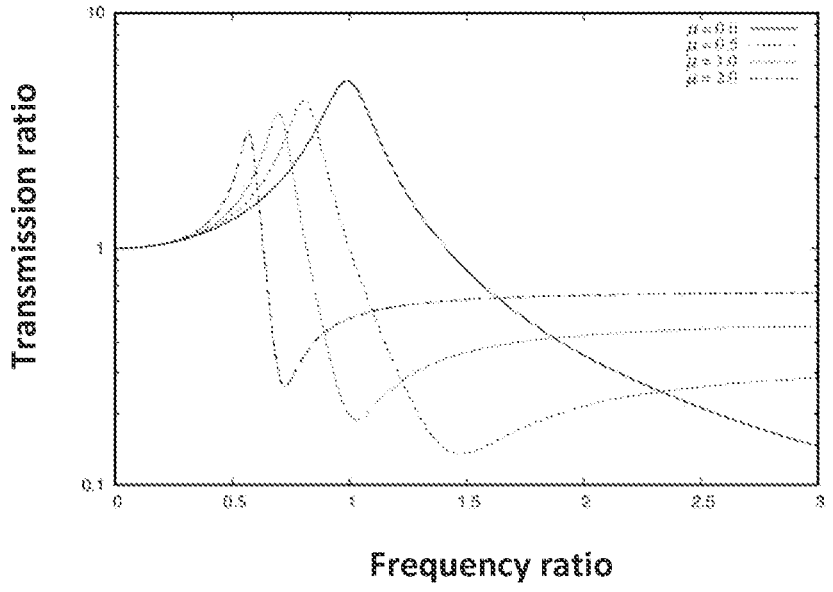
FIG. 17 is a graph of the variation of the transmission ratio with respect to the frequency ratio, which is drawn according to different inertance values.

In FIG. 17, a graph of the variation of the transmission ratio with respect to the frequency ratio, drawn according to different inertance values, is illustrated. In the said graph, "μ" corresponds to the inertance ratio scaled with a reference value in kg. As can be seen from FIG. 17, there is no anti-resonance in the system when the inertance ratio is equal to zero. With the inerter (60), the inertance value of the suspension system (40) is increased, so that the natural frequency can be reduced to lower frequencies and an anti-resonance is incorporated into the system behavior. In this way, a more aggressive and efficient filtering is provided. In addition, one more parameter is added to the filtering characteristics of the inerter (60) and suspension system (40). In this way, the movements of the loading chamber (20) are filtered more effectively.

In the adjustable impedance suspension system (40), an adjustable stiffness module (50) with adjustable spring constant (k) is used in order to adjust the natural frequency ($\omega_n$) of the system. As can be seen in Equation 2, as the spring constant (k) is increased, the natural frequency of the system is increased and as the spring constant (k) is decreased, the natural frequency of the system is decreased. The adjustable stiffness module (50) can change the spring constant (k) of the system manually or automatically. In this way, while the user wearing the suspended-load backpack (10) is walking, the movements of the loading chamber (20) relative to the ground are dampened or filtered. The adjustable stiffness module (50) can be selected as any one of the adjustable stiffness modules (50) in the state of the art.

Referring to FIGS. 3 and 4, said adjustable stiffness module (50) comprises at least one bendable beam (51) suitable to be connected to the loading chamber (20); a movement mechanism (52) suitable for applying force to the beam (51) from at least one end of the beam (51); a spring (53) having one end connected with the first connection portion (41) and the other end connected with the second connection portion (42). The movement mechanism (52) is disposed in the suspension system (40) so as to be suitable for applying force to the beam (51) in both directions in such a way to bend or stretch the beam (51). The value of the spring constant (k) of the beam (51) can be adjusted by the force applied to the beam (51) by the movement mechanism (52). The value of the spring constant (k) of the beam (51) is reduced when a compressive force is applied towards the beam (51) in the bending direction of the beam (51). When a force is applied to the beam (51) in order to stretch the beam (51), the value of the spring constant (k) of the beam (51) is increased. With the adjustable value of the spring constant (k) of the beam (51), the movements of the loading chamber (20) are effectively filtered. In another embodiment of the invention, the movement mechanism (52) can be placed in such a way that it applies force to the beam (51) only from one end. The adjustable stiffness module (50) may comprise one beam (51), or in different versions of the invention it may also comprise more than one beam (51). As the number of beams (51) increases, the value of the total spring constant (k) can be further increased or further decreased. In addition, as the number of beams (51) increases, it is facilitated to guide the loading chamber (20) within the suspension system (40) so that its movement is linear. The suspension system (40) also comprises a spring (53). When the loading chamber (20) is connected to the suspension system (40), the spring (53) exerts a force in a direction opposite to the weight of the loading chamber (20). When the user starts walking while wearing the suspended-load backpack (10), the damping of the movements of the loading chamber (20) relative to the ground is largely accomplished by the movement mechanism (52) by changing the value of the spring constant (k) of the beam (51), and by way of the inerter (60).

Referring to FIGS. 3 and 4, said adjustable stiffness module (50) comprises a connection base (54), which is connected to the beam (51) at one end and suitable for connecting the loading chamber (20) thereon. As can be seen in FIG. 3 or 4, in the preferred embodiment of the invention, the connection base (54) is disposed between two beams (51). In this way, the movement of the connection base (54) and thus the loading chamber (20) within the suspension system (40) is linearly guided. The loading chamber (20) is removably disposed on the connection base (54). In this way, it is ensured that the loading chamber (20) can be easily connected to and disconnected from the suspension system (40).

As can be seen in FIGS. 3 and 4, the adjustable stiffness module (50) comprises a connection means (55) allowing the beam (51) and the connection base (54) to be manually connected and disconnected. The connection base (54) is associated with the spring (53). When the loading chamber (20) is disposed on the connection base (54), the spring (53) experiences some flexion with the weight of the loading chamber (20). In this way, the initial weight of the loading chamber (20) is compensated by the spring (53). After the weight of the loading chamber (20) is compensated by the spring (53), the beam (51) is connected with the connection base (54) by means of the connection means (55). In this way, when the suspended-load backpack (10) is rendered suitable to be worn by the user, the beam (51) is connected with the suspension system (40) in a straight manner. Thus, the beam (51) is connected with the suspension system (40), with its range of motion being at the maximum. In order to filter the movements perpendicular to the ground, caused by the movement of the user, the spring constant (k) of the beam (51) is changed by compressing or stretching the beam (51). Thus, the movements acting on the shoulder of the user are effectively filtered.

In a preferred embodiment of the invention, the connection base (54) is connected to the central point of the beam (51). In this way, the connection base (54) and the loading chamber (20) are guided to move perpendicular to the ground.

In an embodiment of the invention, the suspension system (40) comprises a first connection element (541), which is located on the connection base (54) and allows the loading chamber (20) to be placed on the connection base (54) in a removable manner. In this way, it is facilitated to mount and remove the loading chamber (20) on the connection base (54). In another preferred embodiment of the invention, there is provided a second connection element that facilitates the mounting of the loading chamber (20) to the connection base (54) by mating the loading chamber (20) with the first connection element (541). The first connection element (541) and the second connection element are designed to be interlocked and separated. In this way, it is facilitated to mount and remove the loading chamber (20) on the connection base (54).

In an embodiment of the invention, the suspension system (40) comprises a spring compression mechanism (56), which is associated with the spring (53) and suitable for applying force against the spring (53). When the loading chamber (20) is disposed on the connection base (54), the weight of the loading chamber (20) is compensated by the spring (53). In order to facilitate the compensation of the weight of the loading chamber (20) by the spring (53), the spring compression mechanism (56) applies force to the spring (53). In this way, even when a spring (53) with low spring constant is used, by applying force to the spring (53) by the spring compression mechanism (56), the spring (53) is able to apply a force equal and opposite to the weight of the loading chamber (20) in cases where the loading chamber (20) reaches high weights.

Figure 6:
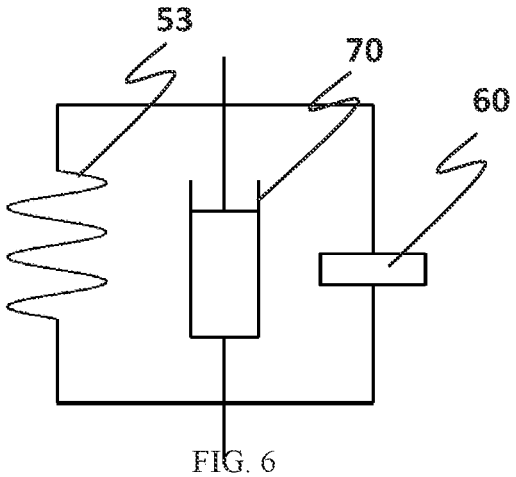
FIG. 6 is a schematic view of the suspension system of the present invention in an embodiment of the invention.
Figure 7:
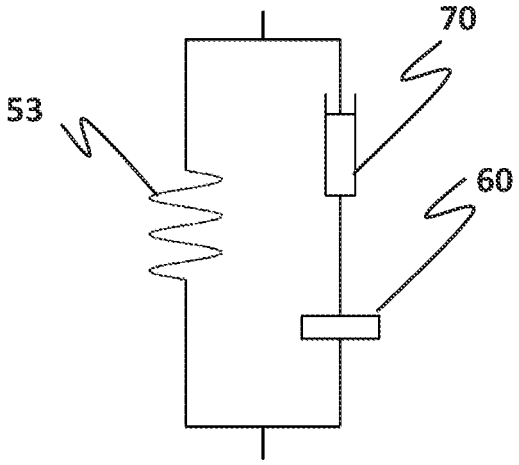
FIG. 7 is a schematic view of the suspension system of the present invention in an embodiment of the invention.
Figure 8:
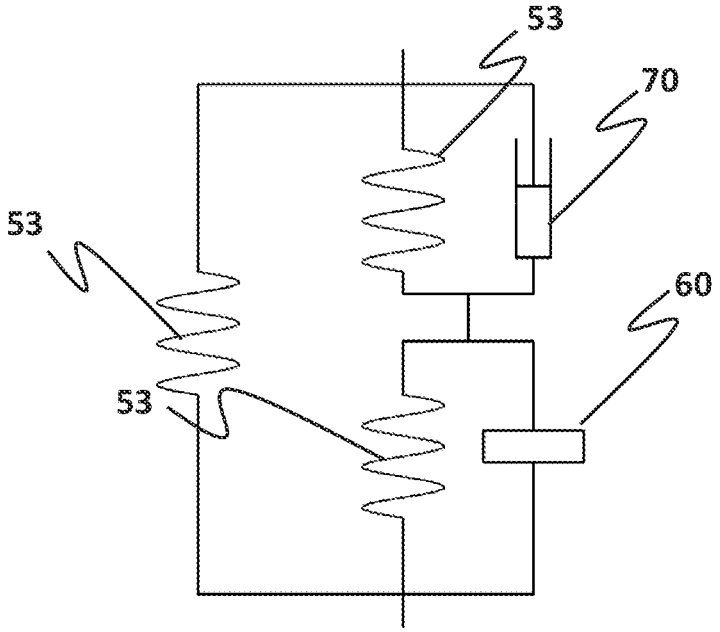
FIG. 8 is a schematic view of the suspension system of the present invention in an embodiment of the invention.
Figure 9:
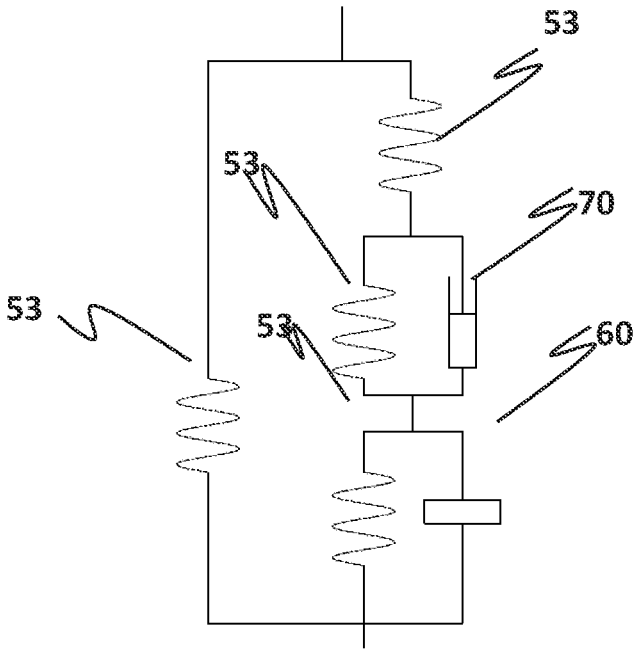
FIG. 9 is a schematic view of the suspension system of the present invention in an embodiment of the invention.

In an embodiment of the invention, the suspension system (40) comprises an auxiliary damping element (70). With the auxiliary damping element (70), the filtering efficiency of the movements perpendicular or parallel to the ground caused by the movement of the suspended-load backpack (10) is increased. In FIG. 6, a schematic system equivalent to the suspension system (40) in FIGS. 3 and 4 is provided. The inerter (60) can be connected to the suspended-load backpack (10) in many different options. In FIG. 6, the spring (53), the auxiliary damping element (70) and the inerter (60) are connected parallel to each other. In an exemplary connection schematic system illustrated in FIG. 7, the inerter (60) is connected with the auxiliary damping element (70) in series whereas it is connected with the spring (53) in parallel. As can be seen in the schematic systems illustrated in FIGS. 8 and 9, the number of the springs (53) used in the suspension system (40) can be increased and the connection topology can be differentiated. In cases where the springs (53) are more than one, the values of the spring constants (k) of the springs (53) may be the same or different from each other. In all of the connection schematic systems illustrated, the inerter (60) is connected in parallel with at least one spring (53).

In an embodiment of the invention, the suspension system (40) comprises a generator (80). By way of the generator (80), it is possible to generate energy from the movements that will occur in the suspension system (40). The generator (80) can be disposed anywhere within the suspension system (40) where there is movement.

Figure 11:
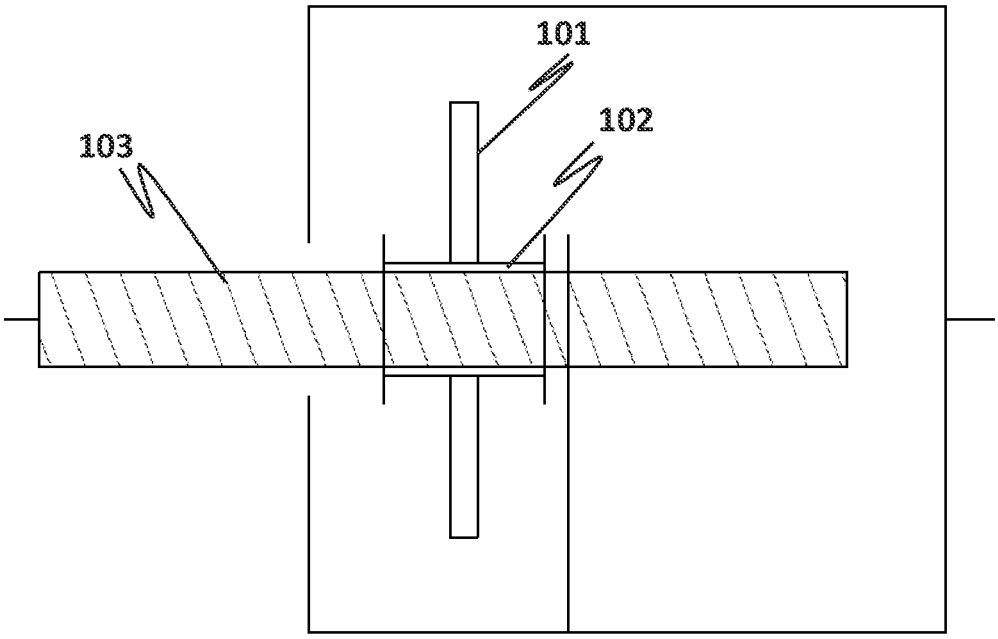
FIG. 11 is a schematic view of another inerter configuration in the suspension system of the present invention.

The inerter (60) illustrated in FIG. 11 comprises a first flywheel (101), a nut (102) and a screw gear (103). The inertia required in the said inerter (60) is obtained by rotating the first flywheel (101).

Figure 10:
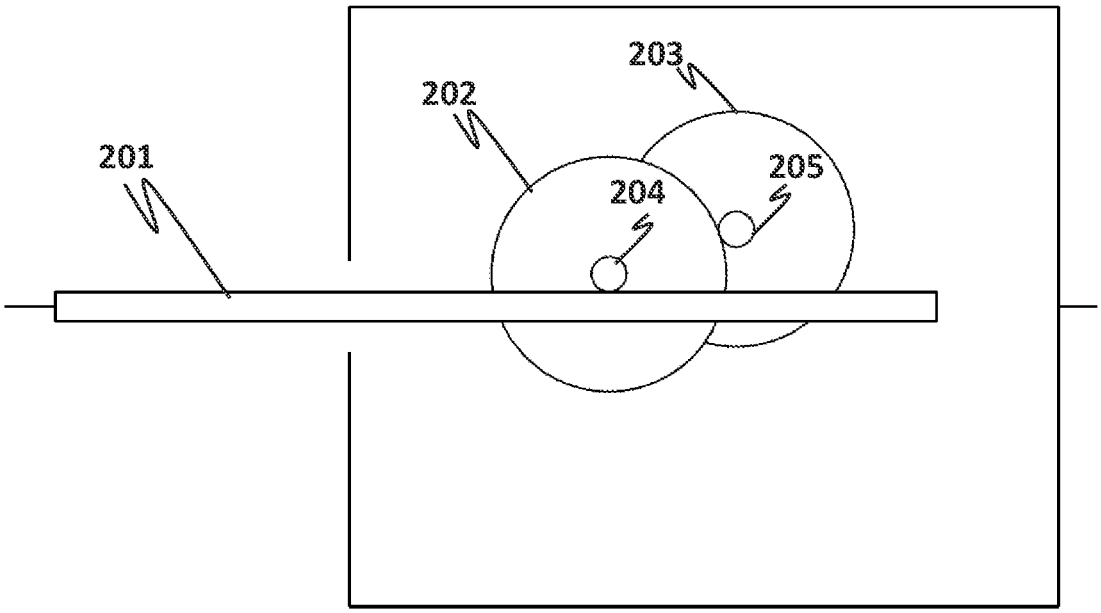
FIG. 10 is a schematic view of an inerter configuration in the suspension system of the present invention.

The inerter (60) illustrated in FIG. 10 comprises a rack (201), a gear element (202) associated with the rack (201), a second flywheel (203) associated with the said gear element (202), a first pinion (204) associated with the said gear element (202) and a second pinion (205) associated with the second flywheel (203).

Figure 12:
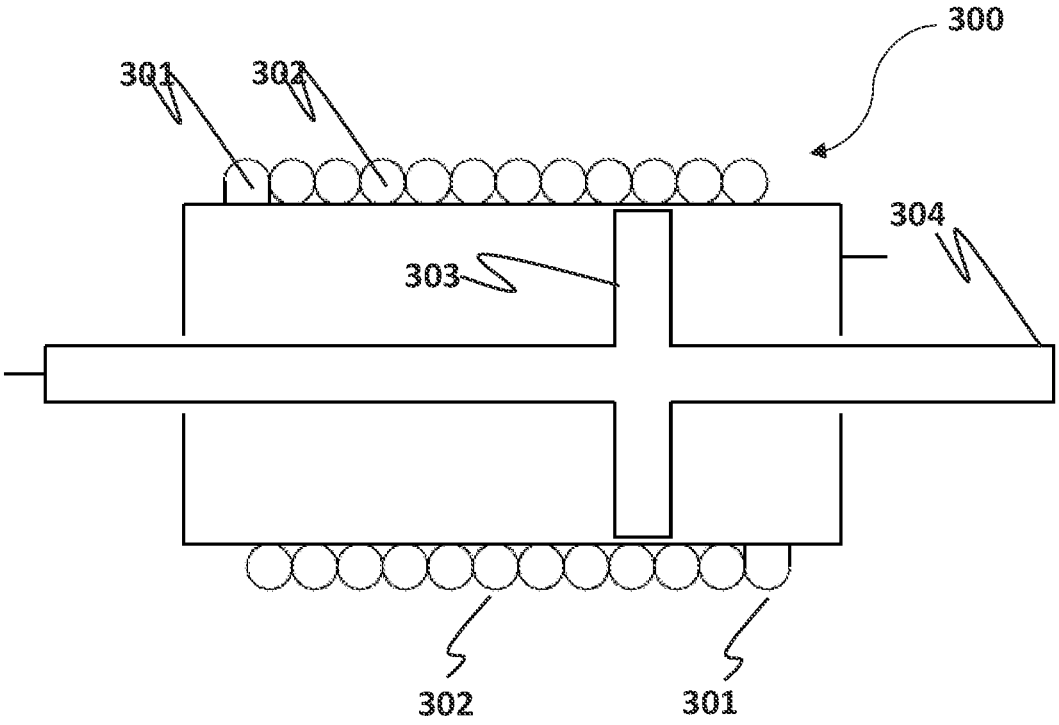
FIG. 12 is a schematic view of another inerter configuration in the suspension system of the present invention.

The inerter (60) illustrated in FIG. 12 is a hydraulic inerter (300). The hydraulic inerter (300) comprises an inlet port (301) suitable for placing hydraulic fluid, a helical tube (302) surrounding the body, a rod (304) passing through the body, and a piston (303) located on the rod (304).

Figure 13:
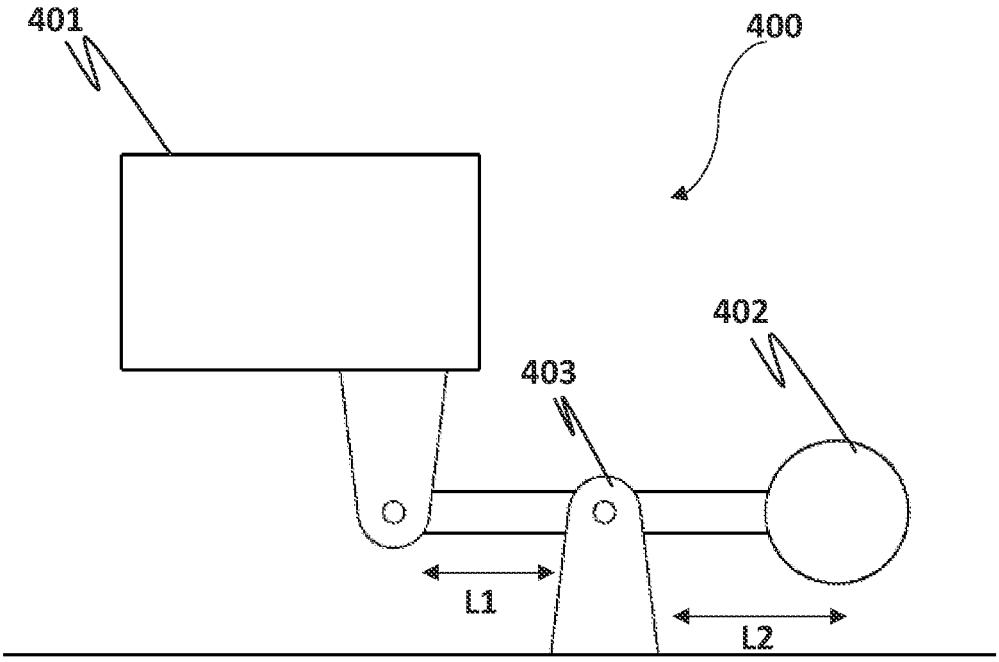
FIG. 13 is a schematic view of another inerter configuration in the suspension system of the present invention.

The inerter (60) illustrated in FIG. 13 is a pivoted flywheel inerter (400). In this inerter, the main mass (401) making small linear movements is connected to the pivot point (403) at a first distance (L1), and an additional mass (402), which creates a flywheel effect and provides additional inertia, is connected to the pivot at the other side at a second distance (L2). Such small linear movements of the main mass (401) cause rapid rotations of the additional mass (402) around the pivot point (403), resulting in high inertance values.

Figure 14:
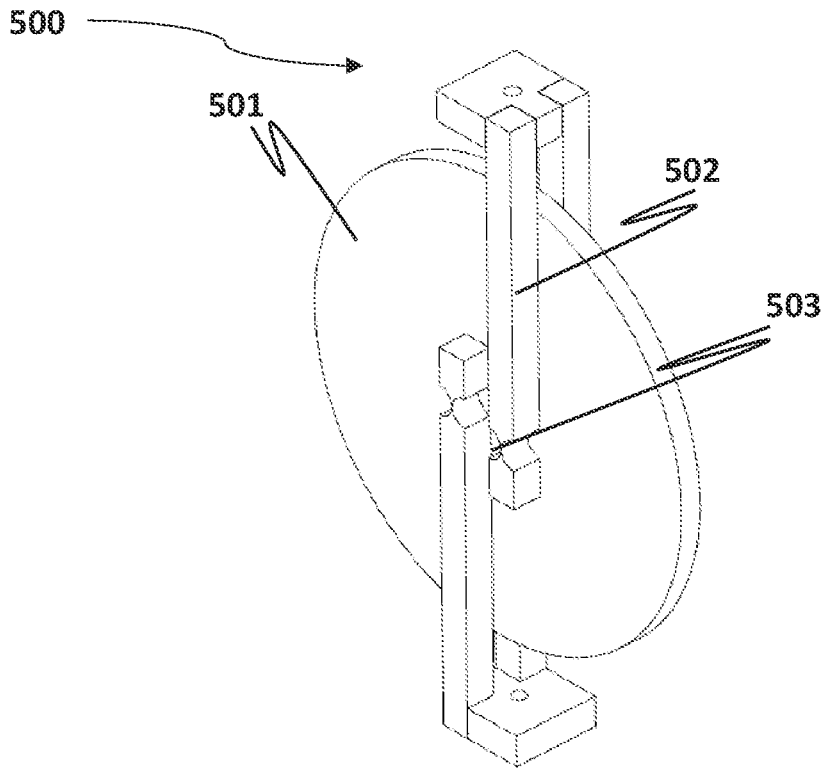
FIG. 14 is a schematic view of another inerter configuration in the suspension system of the present invention.
Figure 15:
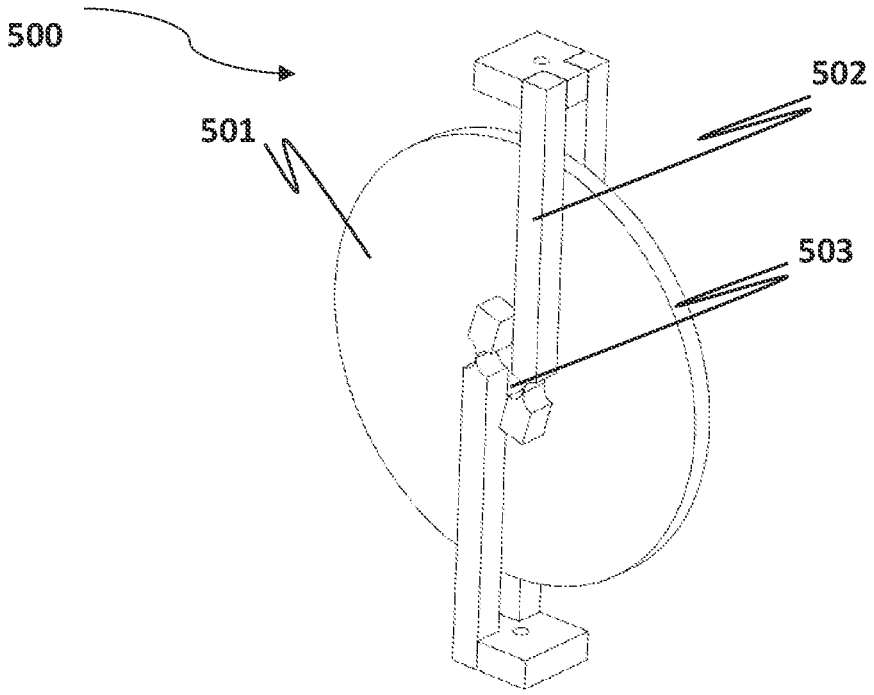
FIG. 15 is another schematic view of the inerter configuration in FIG. 14.

In an embodiment of the invention, the inerter (60) is based on a flexible mechanism. The inerter (60) illustrated in FIGS. 14 and 15 is a flexible pivoted flywheel inerter (500) embodied using the flexible mechanism. Unlike to FIG. 13, all joints in the system are implemented using flexible mechanisms. The flexible pivoted flywheel inerter (500) comprises a third flywheel (501), legs (502) associated with the third flywheel (501) and flexible rotating elements (503). With the use of flexible mechanisms in the flexible pivoted flywheel inerter (500), undesirable effects such as friction, damping and backlash are minimized. In this way, ideal inertance can be added to the suspension system (40) of the inerter (60) without causing other effects such as damping. Thus, the filtering efficiency of the movements of the loading chamber (20) is increased.

Figure 16:
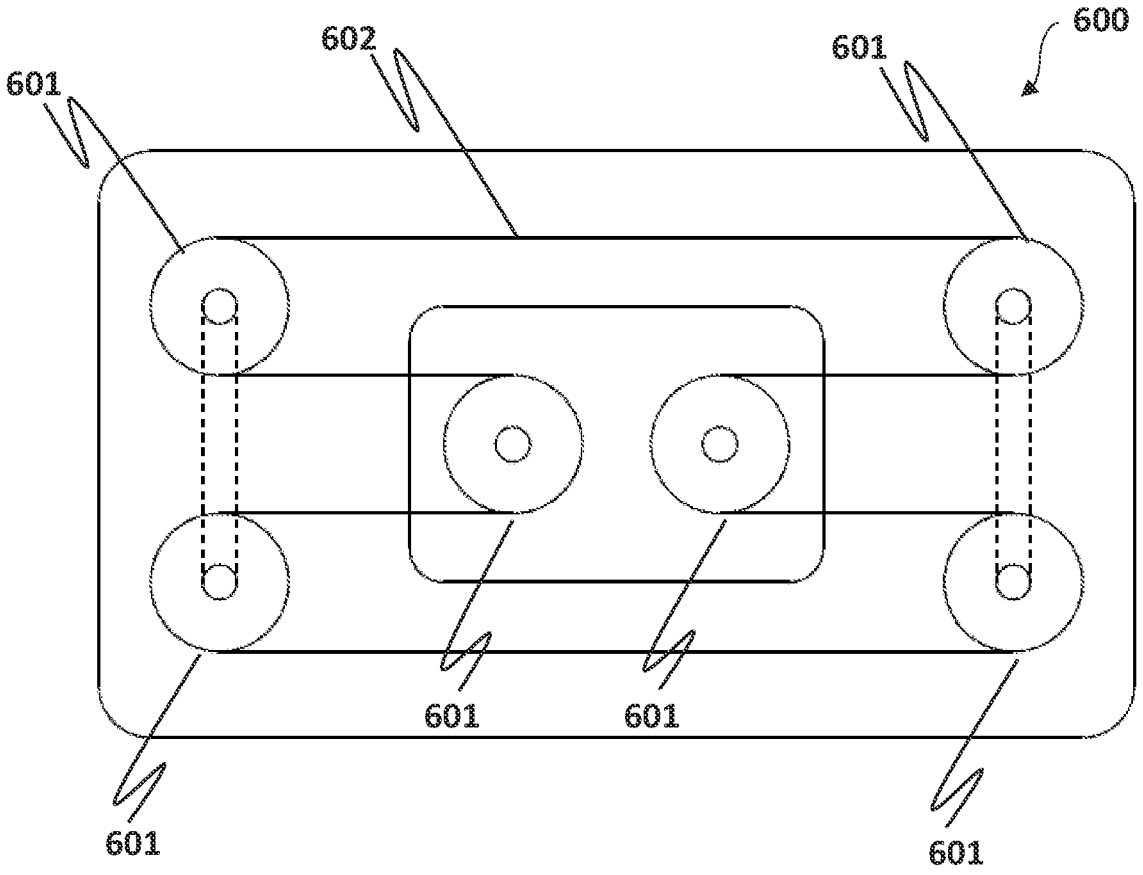
FIG. 16 is a schematic view of another inerter configuration in the suspension system of the present invention.

The inerter (60) illustrated in FIG. 16 comprises a linear harmonic reducer mechanism (600) obtained by means of a plurality of pulleys (601) and a rope (602) connecting said pulleys (601) to each other. With the linear harmonic reducer mechanism (600) obtained by using the pulleys (601) and the rope (602) connecting the pulleys (601), an inerter (60) with low friction, low mass and high inertance values can be obtained. In this way, the movements of the loading chamber (20) are filtered more effectively.

What is claimed is:

1. A suspended-load backpack comprising a loading chamber suitable for placing therein one or more loads to be carried; at least one strap; an adjustable impedance suspension system having a first connection portion where it is connected with the strap and a second connection portion where it is connected with the loading chamber and enabling that the movements of the loading chamber caused by the movement of the user, when in use, are filtered; an adjustable stiffness module located on the suspension system, one end of which is connected with the first connection portion and the other end of which is connected with the second connection portion, wherein the suspension system comprises an inerter which is connected in parallel to the adjustable stiffness module and which increases the effective inertia, wherein the adjustable stiffness module comprises:

at least one bendable beam connected to a connection base, a movement mechanism suitable for applying force to the beam from at least one end of the beam, a spring connected between the connection base and a spring-compression mechanism of the suspension system.

2. The suspended-load backpack according to claim 1, wherein the adjustable stiffness module comprises the connection base which is connected to the beam at one end and suitable for connecting the loading chamber thereon.

3. The suspended-load backpack according to claim 2, further comprising a first connection element, which is located on the connection base and allows the loading chamber to be placed on the connection base in a removable manner.

4. The suspended-load backpack according to claim 3, wherein the suspension system comprises a spring compression mechanism associated with the spring and suitable for applying force to the spring.

5. The suspended-load backpack according to claim 3, wherein the connection base is connected to a central point of the beam.

6. The suspended-load backpack according to claim 3, wherein the suspension system comprises an auxiliary damping element.

7. The suspended-load backpack according to claim 2, wherein the connection base is connected to a central point of the beam.

8. The suspended-load backpack according to claim 7, wherein the suspension system comprises an auxiliary damping element.

9. The suspended-load backpack according to claim 2, wherein the suspension system comprises an auxiliary damping element.

10. The suspended-load backpack according to claim 1, wherein the adjustable stiffness module comprises a connection means allowing the beam and the connection base to be manually connected and disconnected from each other.

11. The suspended-load backpack according to claim 10, wherein the suspension system comprises an auxiliary damping element.

12. The suspended-load backpack according to claim 1, wherein the suspension system comprises an auxiliary damping element.

13. The suspended-load backpack according to claim 1, wherein the suspension system comprises a generator.

14. The suspended-load backpack according to claim 1, wherein said inerter comprises a first flywheel, a nut and a screw gear.

15. The suspended-load backpack according to claim 1, wherein said inerter comprises a rack, a gear element associated with the rack, a second flywheel associated with the gear element, a first pinion associated with the gear element and a second pinion associated with the second flywheel.

16. The suspended-load backpack according to claim 1, wherein the inerter is a hydraulic inerter.

17. The suspended-load backpack according to claim 1, wherein the inerter comprises a linear harmonic reducer mechanism.

18. The suspended-load backpack according to claim 1, wherein the inerter is a pivoted flywheel inerter.

19. The suspended-load backpack according to claim 1, wherein the inerter is based on a flexible mechanism.

* * * * *